United States Patent [19]

Oeberg et al.

[11] Patent Number: 4,457,043

[45] Date of Patent: Jul. 3, 1984

[54] SWEEPER PARTICULARLY FOR COLLECTING DUST-LIKE MATERIAL, AND THE UTILIZATION THEREOF

[75] Inventors: Lennart Oeberg, Oxie, Sweden; Alex Meyerhans, Uitikon, Switzerland

[73] Assignee: Aktiengesellschaft Rolba, Zurich, Switzerland

[21] Appl. No.: 285,185

[22] PCT Filed: Nov. 13, 1980

[86] PCT No.: PCT/CH80/00137

§ 371 Date: Jul. 13, 1981

§ 102(e) Date: Jul. 13, 1981

[87] PCT Pub. No.: WO81/01362

PCT Pub. Date: May 28, 1981

[30] Foreign Application Priority Data

Nov. 16, 1979 [CH] Switzerland ..... 10243/79

[51] Int. Cl.[3] ..... A47L 5/14

[52] U.S. Cl. ..... 15/340; 15/346; 15/347; 15/352

[58] Field of Search ..... 15/340, 346, 347, 352

[56] References Cited

U.S. PATENT DOCUMENTS 978,216 12/1910 Rutherfurd et al. ..... 15/346

1,459,968 6/1923 Bailly ..... 15/346

2,932,845 4/1960 Rydberg ..... 15/346

4,044,422 8/1977 Larsen ..... 15/346 X

*Primary Examiner*—Chris K. Moore

*Attorney, Agent, or Firm*—Lawrence Rosen

[57] ABSTRACT

The problem in picking up and collecting very fine dusts such as aluminum dust, cement and the like is to exhaust the transport air into the atmosphere without dusts. A sweeping machine which offers the solution to said problem comprises the following cooperating parts: a main mouthpiece (9) with at least one nozzle (10) blowing from the outside against the center of the mouth and a suction pipe (12) located inside; a secondary nozzle (15) with a suction conduit (17) movable with respect to the main mouthpiece (9); a common conduit (19) into which the two suction conduits (12, 17) open; a coarse separator (23) arranged in front of a cyclone multiple separator (24, 25, 26); a conduit (34, 35) supplying air from the cyclone on the suction side of a fan (3); a separation piece (4) on the exhaust side of the fan for dividing exhausted air and for supplying a portion of said air to the nozzle (10) blowing into the main mouthpiece (9) and the other portion to a separator (38); and an evacuation fan (45) arranged at the outlet of the separator (38).

8 Claims, 5 Drawing Figures

SWEEPER PARTICULARLY FOR COLLECTING DUST-LIKE MATERIAL, AND THE UTILIZATION THEREOF

The present invention relates to a sweeper particularly for collecting dust-like material and the utilization thereof for collecting aluminum dust in smelting plants, or for collecting cement.

STATE OF THE ART

Street sweeping machines are known (CH Patent 582 281) which, however, are not suitable for collecting fine dusts in industrial plants because said dusts, for example aluminum dust, are only whirled up, but not collected and deposited. The utilization of so-called industrial vacuum cleaners cannot be considered for collecting such dusts in technical plants, because their capacity is much too low.

Summary of the Invention

It is the problem of the present invention to provide a cleaning machine which is suitable for technical, particularly aluminum-processing plants or aluminum smelting works, and capable of collecting and depositing also the finest dusts without enveloping the machine in a cloud of dust while the latter is in operation.

The solution to said problem is offered in the form of the sweeping machine according to the invention.

Said machine is characterized by the cooperation between the following parts:

- a main mouthpiece with at least one nozzle blowing from the outside against the center of the mouthpiece, and a suction pipe inside;
- a secondary nozzle with a suction conduit arranged movable with respect to the main mouthpiece;
- a common conduit into which the two suction pipes open;
- a coarse separator arranged in front of a cyclone multiple separator;
- a conduit carrying the exhaust air of the cyclone and connected to the suction side of a fan;
- a separating piece on the exhaust side of the fan for dividing the exhausted air and for feeding a portion of said air to blowing nozzles in the main mouthpiece and the other portion to another separator; and
- an evacuating fan arranged at the outlet of said other separator.

BRIEF DESCRIPTION OF THE DRAWINGS

An embodiment of the object of the invention is explained in the following with the help of the drawing in which.

DESCRIPTION OF THE INDIVIDUAL FIGURES

Figure 1:
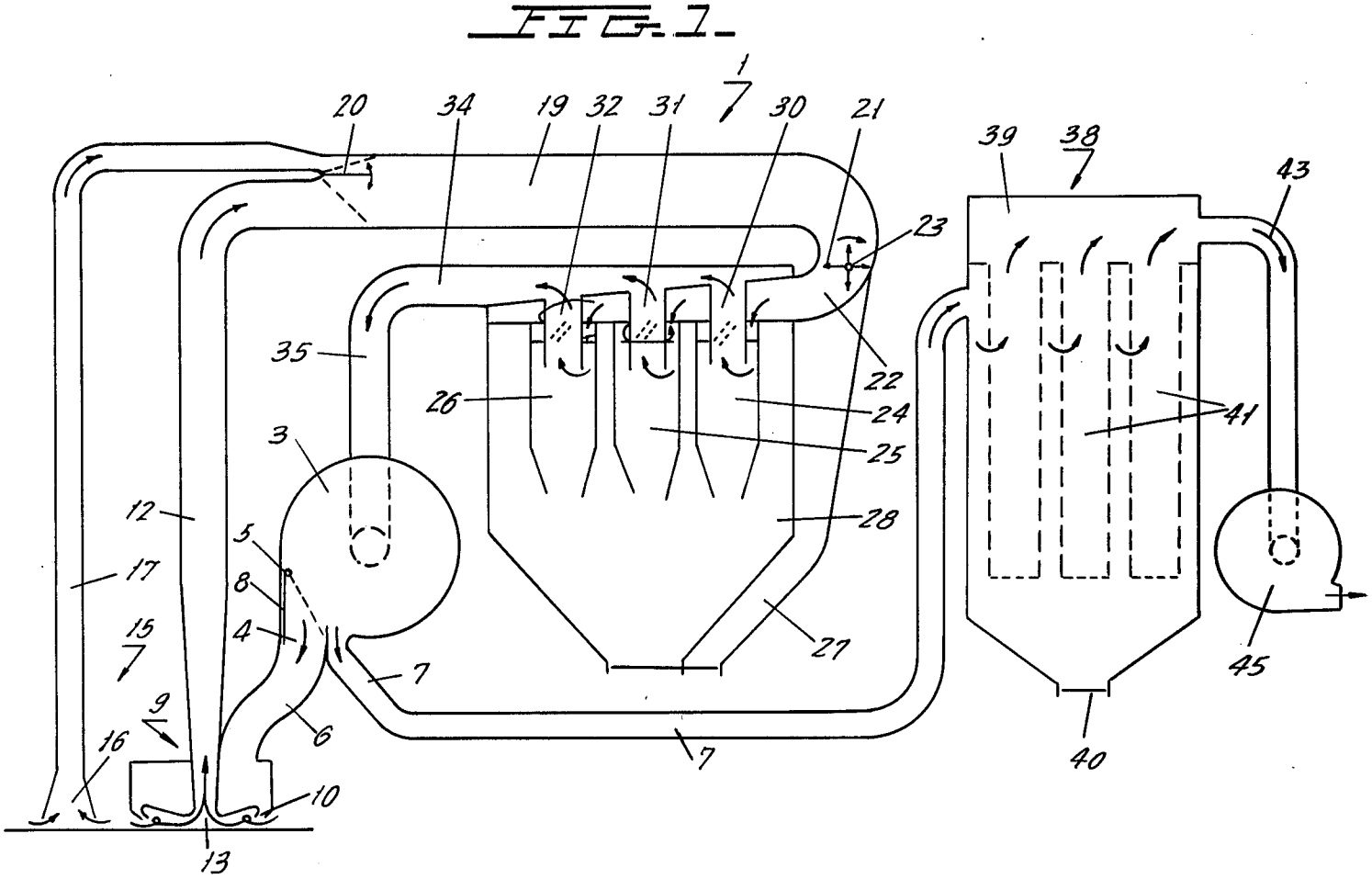
FIG. 1 shows a circuit diagram of a sweeping machine for collecting aluminum dust.

FIG. 1 shows the circuit diagram of an arrangement 1 for receiving aluminum dust, with the pneumatic system and the separating system. The pneumatic system is provided with a main blower 3 with pressure pipe 4, the latter being divided into a main conduit 6 and a secondary conduit 7. The conveyed air is divided by means of a flap 8 capable of being swiveled around an axle 5. Said flap may be adjusted by hand by way of a lever system or by means of a servo motor. The main conduit 6 feeds into a main mouthpiece 9 and supplies a lateral ring nozzle 10—or a plurality of nozzles extending over at least a portion of the circumference—with pressure air blowing the dust against the center of the main mouthpiece 9. Here, the air laden with aluminum dust is exhausted by a main conduit 12 having a suction nozzle 13 (arranged in the center or off center). In addition to the main mouthpiece 9, the arrangement is provided with a secondary nozzle 15 having a funnel 16 and a suction conduit 19, said suction conduit 19 being movable, having the form, for example of a hose conduit. The suction conduit 17 and the main suction conduit 12 join each other in a common conduit 19, with an adjustable flap 20 being arranged at the point where conduits 17 and 12 join in order to adjust the amounts of air. The common conduit 19 is continued in the form of a cyclone inlet 22, Said inlet accommodates a revolving, for example motor-driven vaned separator wheel 23. Said wheel decelerates the coarse parts such as paper, parts of face masks and like, whereas the conveyed air with the aluminum dust, with only little obstruction offered by the perforated vanes 21, is divided onto three cyclones 24, 25 and 26. The coarse parts are discharged by way of a conduit 27, whereas the fine particles, which are separated in the multiple cyclone, are collected in collecting bin 26 and discharged from said bin. The three cyclones are accommodated in a collecting bin 28. The center suction pipes 30, 31 and 32 of cyclones 24, 25 and 26 feed into a cyclone exhaust pipe 34 changing into a fan suction pipe 35 feeding into the suction pipe of blower 3. The mode of operation of said multiple cyclone is not described here in detail, i.e., the dividing of the air, the spiral-like feeding of the air into the cyclones, the depth of the immersion pipes referred to as the exhaust conduit and the like, because said details are basically prior art.

The secondary conduit 7 feeds into a hose filter 38 with a chamber 39 and an outlet 40. Said chamber 39 contains in the known manner filter bags 41 suspended in said chamber next to each other or one after the other. The fine dust received is unloaded at outlet 40, whereas the exhausted air is exhausted by way of an exhaust conduit 43 into an exhaust blower 45 blowing the air, which is practically free of aluminum dust, into the atmosphere. Also the hose filter 38 is not described in greater details such as, for example, the automatic cleaning by shaking the filter bags, the exchange of said bags, the utilization of suitable fabrics etc, because said details are prior art.

Figure 2:
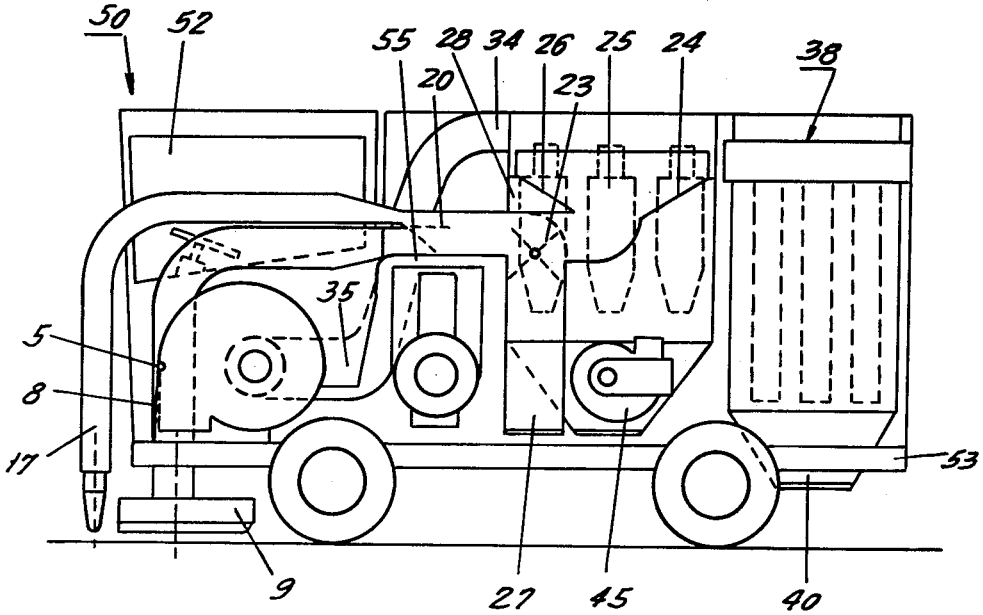
FIG. 2 is a schematic view of a sweeping machine shown in a lateral view.
Figure 3:
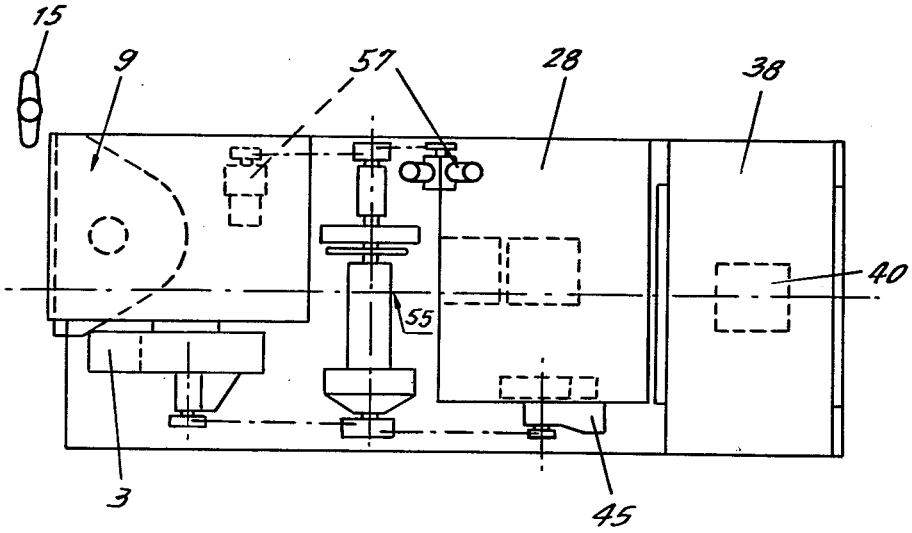
FIG. 3 is a top view of the sweeping machine according to FIG. 2.
Figure 4:
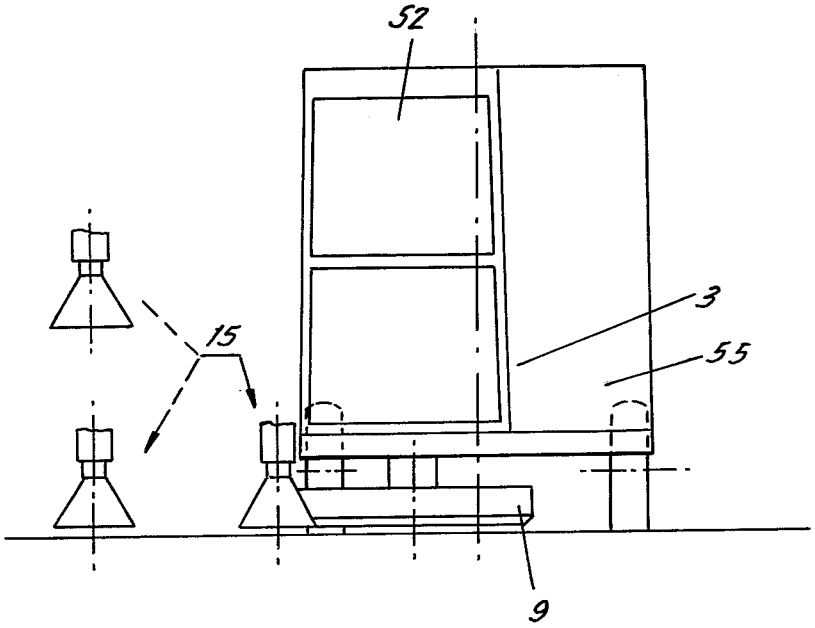
FIG. 4 is a front view of the sweeping machine according to FIG. 2.
Figure 5:
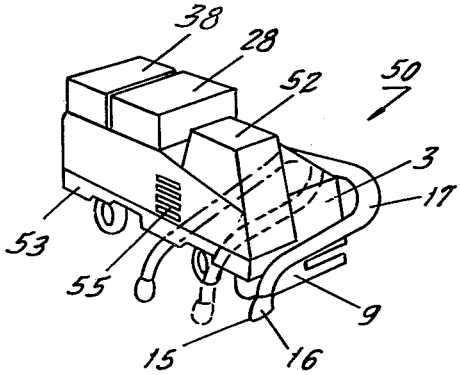
FIG. 5 is a perspective view of the model of a sweeping machine analogue to FIGS. 2 to 4, showing the secondary nozzle in three positions (indicated by full, dashed and dash-dotted lines).

FIG. 5 shows a four-wheel vehicle 50 with a control stand 52 and a platform 53 on which the blower 3, the main mouthpiece 9 and the secondary nozzle 15 can be seen. The collecting bin 28 with the cyclones is shown schematically, as well as the hose filter 38 with the interior filter bags, the entire four-wheel vehicle 50 with the control stand 52 and platform 53. Moreover, the figure shows a driving assembly 55—which is shown also in FIGS. 2 to 4—with auxiliary equipment 57. The secondary nozzle 15 with its movable suction conduit 17 which, for example, may be provided in the form of a hose, is arranged displaceably, with the normal working position shown in FIG. 5 by the drawnout line, the dashed lines showing its position for sweeping corners, and the dash-dotted lines its position for cleaning elevated areas, for example the walls around furnaces.

Best way of implementing the invention

A sweeper based on the principle according to FIGS. 1 to 5 is capable of collecting the finest aluminum dust and of separating and trapping said dust without discharging said dust again into the atmosphere at some other point.

Commercial utilization

Apart from aluminum dust it is possible also to collect other fine dusts such as, for example, cement and fine dusts of that type.

We claim:

1. A sweeper particularly for collecting dust-like material, characterized by a moveable frame on which the following parts are mounted:

a main mouthpiece with at least one nozzle blowing from the outside against the center of the mouthpiece, and an inside suction pipe;

a secondary nozzle arranged moveably with respect to the main mouthpiece and having a separate suction pipe;

a common conduit into which both of said suction pipes open;

a coarse separator arranged on the inlet side of a multiple cyclone separator;

a cyclone exhaust conduit connected to center suction pipes in the multiple cyclone separator for conveying exhaust air to the suction side of a blower;

a separating piece arranged on the exhaust side of the blower for dividing the exhaust air in order to feed a portion thereof to the blowing nozzle in the main mouthpiece and the other portion of the exhaust to a second separator; and an evacuation fan arranged at the outlet side of the second separator.

2. A sweeper as defined in claim 1, characterized by the fact that the second separator is a hose filter.

3. A sweeper as defined in claim 1, characterized by the separating piece being a swivelable flap for controlling at least the flow of air to the blowing nozzle.

4. A sweeper as defined in claim 1, characterized by the fact that the coarse separator is a driven vane wheel preferably having perforated vanes.

5. A sweeper as defined in claim 4, characterized by a collecting conduit connected downstream of the vane wheel and forming part of a collecting bin for the multiple cyclone separators.

6. A sweeper as defined in claim 1, characterized by the fact that the suction pipe is arranged in the center and that the blowing nozzle extends over at least a portion of the circumference of the main mouthpiece.

7. A sweeper as defined in claim 1, characterized by the fact that the secondary nozzle is arranged on a hose pipe.

8. A sweeper as defined in claim 1 characterized by the moveable frame, having said parts mounted therein, is positioned on a four-wheel vehicle.

* * * * *